US007892030B2

(12) United States Patent
Chang

(10) Patent No.: US 7,892,030 B2
(45) Date of Patent: Feb. 22, 2011

(54) CONNECTOR WITH CONTROL AND STORAGE FUNCTIONS

(76) Inventor: Nai-Chien Chang, 5F., No. 15, Lane 117, Sec. 4, Sanhe Rd., Sanchong City, Taipei Country 241 (TW)

( * ) Notice: Subject to any disclaimer, the term of this patent is extended or adjusted under 35 U.S.C. 154(b) by 2 days.

(21) Appl. No.: 12/577,411

(22) Filed: Oct. 12, 2009

(65) Prior Publication Data

US 2010/0159747 A1 Jun. 24, 2010

(30) Foreign Application Priority Data

Dec. 22, 2008 (TW) ..... 97223003 U

(51) Int. Cl.
*H01R 13/648* (2006.01)

(52) U.S. Cl. ..... 439/607.35; 439/76.1

(58) Field of Classification Search ..... 439/607.35, 439/676, 625, 620.22, 55, 660, 541.5, 540.1, 439/76.1, 607.01, 607.4, 620.1, 620.11, 620.12, 439/620, 620.19
See application file for complete search history.

(56) References Cited

U.S. PATENT DOCUMENTS 7,182,649 B2 * 2/2007 Caveney et al. ..... 439/676
7,252,552 B2 * 8/2007 Takimura et al. ..... 439/620.22
7,625,245 B1 * 12/2009 Yao ..... 439/660
7,740,490 B1 * 6/2010 Chang ..... 439/76.1
2003/0194908 A1 * 10/2003 Brown et al. ..... 439/620

* cited by examiner

*Primary Examiner*—Edwin A. Leon
(74) *Attorney, Agent, or Firm*—Chun-Ming Shih; HDLS IPR Services

(57) ABSTRACT

A connector with control and storage functions includes a housing, a base, a terminal set, a control module and a cover. The housing includes an interface and an opening formed at front and rear ends of the housing respectively. The base inside the housing includes a stop block, a load carrying portion on the stop block, and through holes formed on the stop block. The terminal set in the load carrying portion and the through hole includes a slot at a rear side of the terminal set. The storage module electrically coupled to the terminal set includes a printed circuit board electrically coupled to a control unit and a storage unit. The cover includes first and second cover plates connected into the slot. The control module is provided for controlling the electronic product, storing data required by the electronic product, and increasing the storage capacity of the electronic product.

9 Claims, 4 Drawing Sheets

CONNECTOR WITH CONTROL AND STORAGE FUNCTIONS

BACKGROUND OF THE INVENTION

1. Field of the Invention

The present invention relates to a connector, and more particular to a connector with a storage function.

2. Description of Prior Art

Electric connector refers to a connecting device and its accessories used for connecting electronic signals and power. For example, connectors are required for connecting a computer with its peripherals such as a mouse, a display, a keyboard and a printer, or connecting electric signals between modules such as an integrated circuit socket, and a board rim in a device. Therefore, electric connector is one of the essential components of an electronic product.

In recent years, science and technology advance continuously, new-generation electric connectors such as the USB, HDMI, Displayport, eSATA and SATA connectors are introduced. In these electric connectors, some can reduce the number of transmission lines and improve the transmission speed. For example, at least three transmission lines were required for transmitting audio and video data in the past, but now only one HDMI line is required for achieving the transmission of audio and video data, or some manufacturers stack or combine several functional electric connectors together to form a multi-port electric connector, such that a multi-port electric connector can be provided for connecting several different functional transmission lines.

The aforementioned connector simply achieves the effects of simplifying the tangled lines of the electronic product, overcoming the data transmission speed, and providing a connector for connecting a plurality of transmission lines, but it cannot save data of the electronic product or improve the data storage capacity of the electronic product.

SUMMARY OF THE INVENTION

Therefore, it is an objective of the present invention to overcome the shortcomings of the prior art by providing a connector with control and data storage functions, wherein a control module and an electric connector are integrated to form the connector, such that the connector can be used for controlling an electronic product and the data required by the electronic product, as well as increasing the storage capacity of the electronic product.

To achieve the foregoing objective, the present invention provides a connector with a storage function, and the connector comprises:

a housing, having a hollow body disposed thereon, an interface disposed at a front end of the housing, and an opening formed at a rear end of the housing;

a base, disposed inside the housing, and having a stop block disposed on the base, a load carrying portion disposed on the stop block and extended into the interface, a plurality of through holes formed on the stop block, and a slot formed at a rear side of the stop block;

a terminal set, comprised of a plurality of conductive pins, and each conductive pin having a first-section pin and a second-section pin, and the first-section pin being installed onto the load carrying portion, and the second-section pin being installed into the through hole and extended into the slot;

a data storage module, electrically coupled to the terminal set, and having a printed circuit board installed thereon, and the printed circuit board being electrically coupled to a data storage unit, and the printed circuit board having a plurality of insert holes disposed at an end of the printed circuit board and provided for inserting the second-section pins respectively, and a plurality of conductive pillars electrically coupled to another end of the printed circuit board;

a cover, being an L-shaped body made of a plastic material, and having a first cover plate and a second cover plate thereon, and the first cover plate having a plurality of penetrating holes for passing the conductive pillars respectively, and two protrusions disposed on both sides of the first cover plate and coupled to the two recessions respectively.

Therefore, the control module is installed at the connector to simplify the internal structure of the electronic product or the design of the printed circuit board, so as to simplify the design of the electronic product.

DETAILED DESCRIPTION OF THE INVENTION

Figure 1:
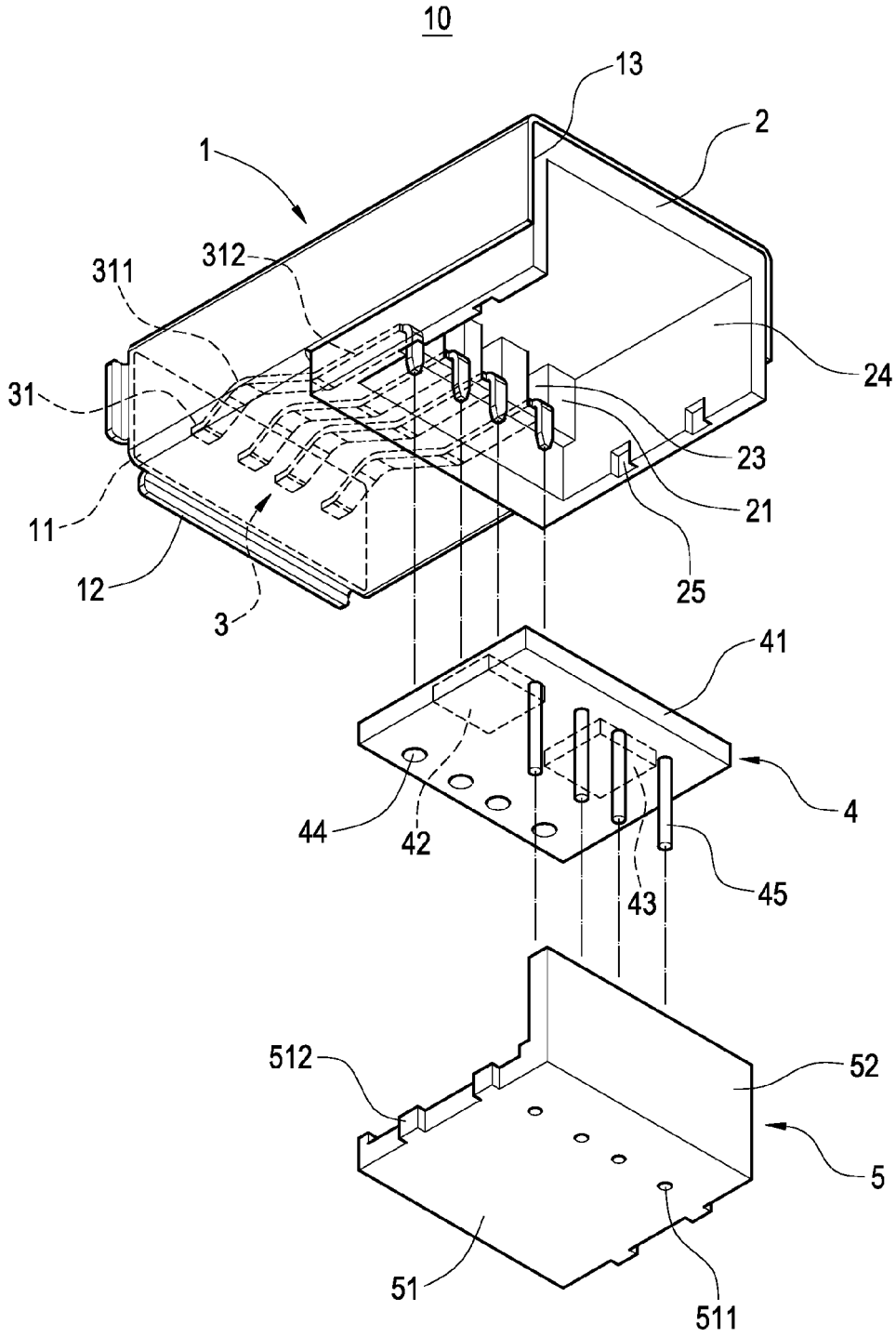
FIG. 1 is an exploded view of a connector of the present invention.
Figure 2:
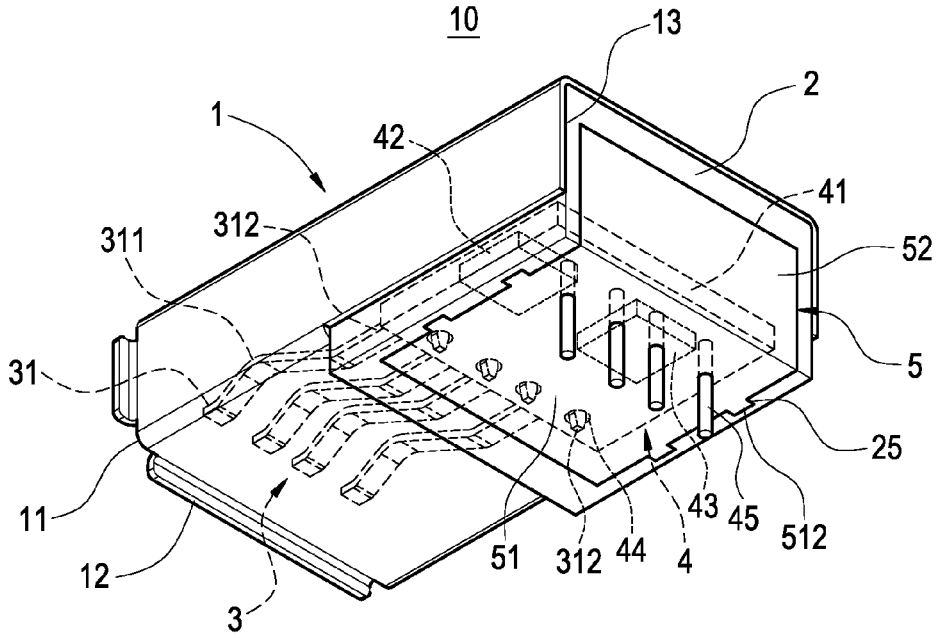
FIG. 2 is a bottom view of a connector of the present invention.
Figure 3:
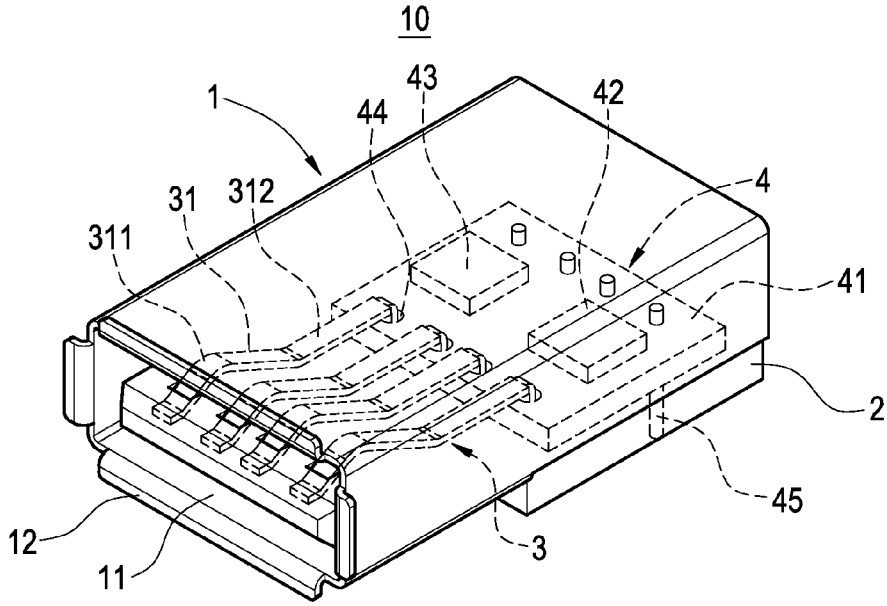
FIG. 3 is a schematic view of an assembled connector of the present invention viewed from another angle.

The technical characteristics, features and advantages of the present invention will become apparent in the following detailed description of the preferred embodiments with reference to the accompanying drawings. The drawings are provided for reference and illustration only, but not intended for limiting the present invention.

With reference to FIGS. 1 to 4 for an exploded view, a bottom view, a schematic view from another angle and a cross-sectional side view of a connector in accordance with the present invention respectively, the connector with a storage function comprises a housing 1, a base 2, a terminal set 3, a control module 4 and a cover 5.

The housing 1 is a hollow body made of a metal material, and includes an interface 11 at a front end of the housing 1, a plurality of arc stop plates 12 installed around the periphery of the interface 11, and an opening 13 formed at an end of the housing 1.

The base 2 is made of a plastic material and disposed inside the housing 1. The base 2 includes a stop block 21, a load carrying portion 22 extended from the stop block 21 and disposed in the load carrying portion 22, and the stop block 21 includes a through hole 23 for passing the terminal set 3, such that an end of a conductive pin 31 of the terminal set 3 is extended onto the load carrying portion 22. In addition, a slot 24 is formed at a rear side of the base 2, and two corresponding recessions 25 are formed on both sidewalls of the base 2 of the slot 24.

The terminal set 3 is comprised of a plurality of conductive pins 31, and each conductive pin 31 includes a first-section pin 311 and a second-section pin 312, and the first-section pin 311 is in an arc shape and installed onto the load carrying portion 22, and the second-section pin 312 is in an L-shape and installed into the through hole 23 and extended into the slot 24.

The control module 4 includes a printed circuit board 41 installed thereon, and electrically coupled to a control unit 42 and a storage unit 43, and the control unit 42 is electrically coupled to the storage unit 43. In addition, a plurality of insert holes 44 are formed at an end of the printed circuit board 41, and a plurality of conductive pillars 45 disposed at another end of the printed circuit board 41, and the insert hole 44 is provided for inserting the second-section pin 312, such that the terminal set 3 is electrically coupled to the printed circuit board 21. In these figures, the control unit 42 is a microprocessor, and the storage unit 42 is a memory.

The cover 5 is an L-shaped body made of a plastic material and includes a first cover plate 51 and a second cover plate 52, and the first cover plate 51 includes a plurality of penetrating holes 511 through which the conductive pillar 45 pass, and two protrusions 512 are formed on both sides of the first cover plate 51 for coupling the two recessions 25 respectively. When the cover 5 is installed and coupled to the slot 24, the conductive pillar 43 is passed through the penetrating hole 511 from the first cover plate 51, such that the two protrusions 512 on both sides of the first cover plate 51 are connected with the two recessions 25 respectively.

Figure 4:
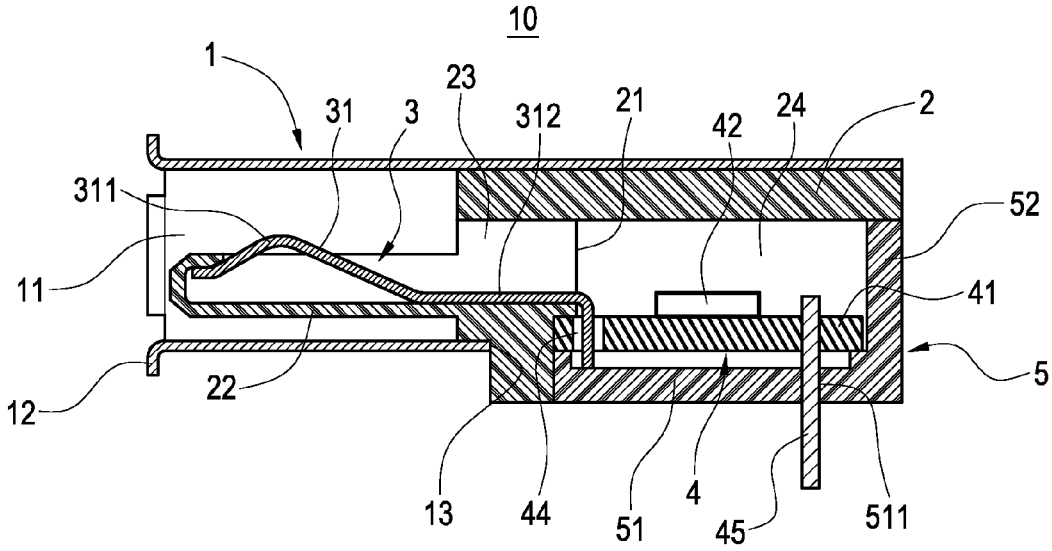
FIG. 4 is a cross-sectional side view of a connector of the present invention.

With reference FIG. 4 for a cross-sectional side view of a connector of the present invention, after the connector 10 is assembled a control module 4 is installed inside the connector 10 for controlling an electric connection of an electronic device (not shown in the figure) and storing related data of the electronic device. The connector 10 connected to the control module 4 is a USB, HDMI, Displayport, PS/2, eSATA, micro-USB, MINI USB, or IEEE1394 collector.

Figure 5:
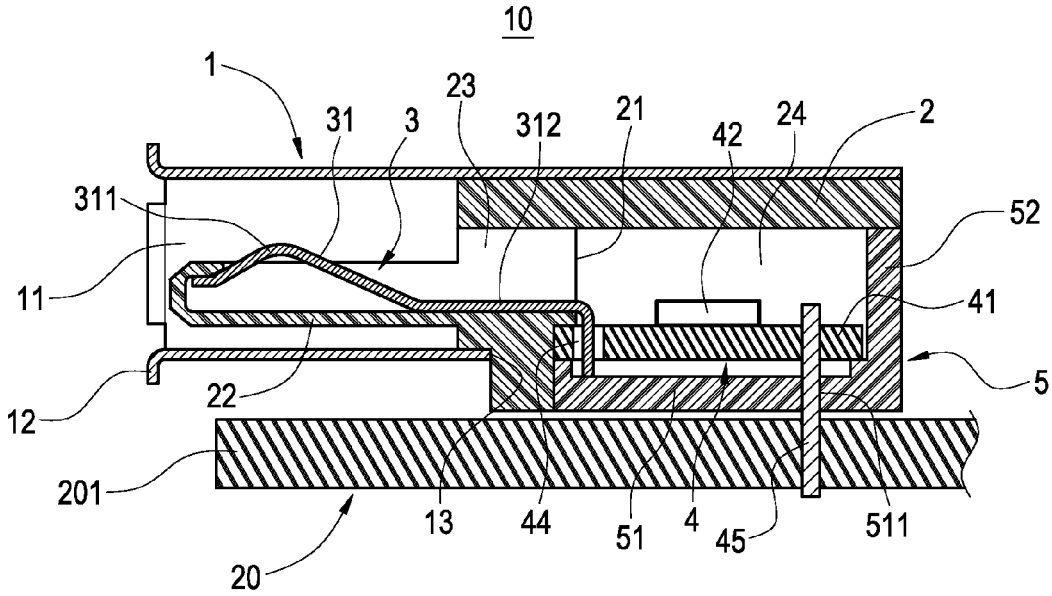
FIG. 5 is a cross-sectional side view of a connector electrically coupled to an electronic product in accordance with the present invention.
Figure 6:
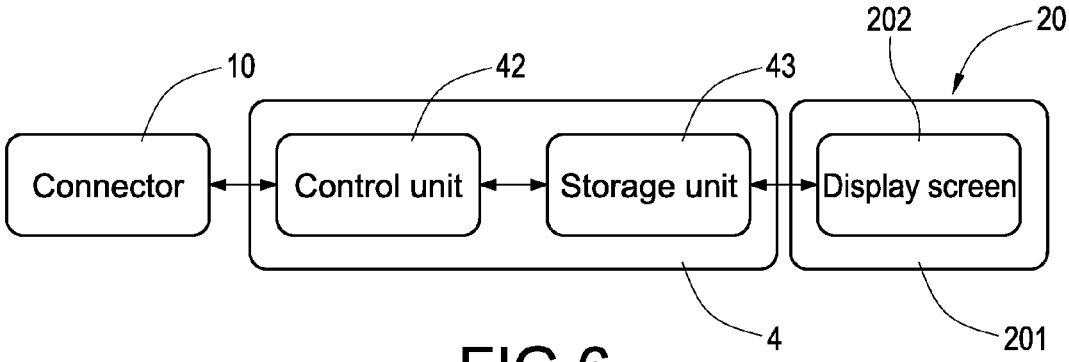
FIG. 6 is a circuit block diagram of a connector electrically coupled to an electronic product in accordance with the present invention.

With reference to FIGS. 5 and 6 for a cross-sectional side view and a circuit block diagram of a connector electrically coupled to an electronic product in accordance with the present invention, after the connector 10 of the present invention is electrically coupled to a main board 201 of the electronic product 20 through the plurality of conductive pillars 44, the control unit 42 of the control module 4 serves as a control center of the electronic device 20, and the storage unit 43 serves as a built-in memory of the electronic product 20 for storing required data of the electronic product 20. Alternatively, the connector 10 is electrically coupled to a transmission line or a USB flash memory (not shown in the figure) through the interface 11, and external inputted data can be stored into the storage unit 43 by the control of the control unit 42.

If the electronic product 20 comes with a display screen 202, and the electronic product 20 is electrically coupled to the connector 10, and some multimedia data are stored into the storage unit 43, the display screen 202 will be able to play the multimedia data such as related data of advertising, digital photos and digital images by the control of the control unit 42. Through the interface 11, the connector 10 can be electrically coupled to an external transmission line or USB flash memory, such that data processed by the control unit 42 can be transmitted into the storage unit 43 for data download or update.

If the connector of the present invention is applied to a massage chair, a control program and related parameters are stored in the storage unit 43, and the connector 10 is electrically coupled to a driving mechanism of the massage chair. By the control of the control unit 42, the program and parameters stored in the storage unit 43 can be used for controlling the driving mechanism to achieve the effect of controlling the massage chair.

In summation, the connector 10 includes an additional control module 4 for simplifying the internal structure of the electronic product 20 or the design of the printed circuit board, so as to simplify the design of the electronic product 20.

The present invention is illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A connector with control and storage functions, electrically coupled to an electronic product, for controlling an electronic and storing related data, and the connector comprising:

a housing, being a hollow body, and having an interface disposed at a front end of the housing and an opening disposed at a rear end of the housing;

a base, disposed inside the housing, and having a stop block, and the stop block having a load carrying portion extended into the interface, a plurality of through holes formed on the stop block, and a slot disposed at a rear side of the stop block;

a terminal set, installed at the load carrying portion and into the through hole, and comprised of a plurality of conductive pins, each conductive pin having a first-section pin and a second-section pin, and the first-section pin being installed onto the load carrying portion, and the second-section pin being installed into the through hole and extended into the slot; and a control module, electrically coupled to the terminal set, and having a printed circuit board electrically coupled to a control unit and a storage unit, and the control unit being electrically coupled to the storage unit; and a plurality of insert holes being disposed at an end of the printed circuit board for inserting the second-section pin, and another end being electrically coupled to a plurality of conductive pillars.

2. The connector of claim 1, wherein the housing is made of a metal material.

3. The connector of claim 1, wherein the interface includes a plurality of arc stop plates installed around the periphery of the interface.

4. The connector of claim 1, wherein the base is made of a plastic material.

5. The connector of claim 1, wherein the slot includes two corresponding recessions formed on two sidewalls of the slot respectively.

6. The connector of claim 1, wherein the control unit is a microprocessor.

7. The connector of claim 1, wherein the storage unit is a memory.

8. The connector of claim 1, wherein the base further includes a cover coupled to the slot, and the cover is an L-shaped body made of a plastic material and including a first cover plate and a second cover plate, and the first cover plate includes a plurality of penetrating holes formed thereon, and provided for passing through the conductive pillars, and two protrusions disposed on both sides of the first cover plate and coupled to the two recessions respectively.

9. The connector of claim 1, wherein the connector is one selected from the group consisting of a USB connector, a HDMI connector, a Displayport connector, a PS/2 connector, an eSATA connector, a micro-USB connector, a MINI USB connector, and an IEEE1394 connector.

* * * * *